US005184553A

United States Patent [19]

Kobler et al.

[11] Patent Number: 5,184,553

[45] Date of Patent: Feb. 9, 1993

[54] SUCTION TRANSFER ACTUATION SYSTEM FOR A MULTI-COLOR SHEET-FED ROTARY PRINTING PRESS

[75] Inventors: Ingo Kobler, Anhausen; Joseph Mathes, Offenbach am Main, both of Fed. Rep. of Germany

[73] Assignee: MAN Roland Druckmaschinen AG, Fed. Rep. of Germany

[21] Appl. No.: 688,042

[22] Filed: Apr. 19, 1991

[30] Foreign Application Priority Data

Apr. 19, 1990 [DE] Fed. Rep. of Germany ..... 4012498

[51] Int. Cl.[5] ..... B41F 21/06; B65H 5/12

[52] U.S. Cl. ..... 101/409; 271/276

[58] Field of Search ..... 101/409, 415.1, 188; 271/277, 276

[56] References Cited

U.S. PATENT DOCUMENTS 3,537,391 11/1970 Mowry et al. ..... 101/188
4,583,728 4/1986 Mathes ..... 271/277 X
4,790,244 12/1988 Otfried et al. ..... 101/410 X

FOREIGN PATENT DOCUMENTS 3641439 10/1987 Fed. Rep. of Germany .
1462745 1/1977 United Kingdom .

*Primary Examiner*—Clifford D. Crowder
*Attorney, Agent, or Firm*—Leydig, Voit & Mayer

[57] ABSTRACT

A suction transfer actuation system for a transfer drum of a multi-color sheet-fed rotary printing press for turning successive sheets, by rear-edge turning, during the sheet transfer from one printing unit to another to facilitate printing on the back side of the sheets. A plurality of suction arms are rigidly connected to a hollow suction rocker shaft connected to actuating levers carrying guide rollers engaging curved guide cam surfaces on a guide bar mounted on the transfer drum. The suction actuation system is driven by way of a cam rigidly mounted on the press frame engaged by a cam follower roller to oscillate a drive lever coupled by a link to a drive arm on the rocker shaft to rock the suction arms toward and away from the one printing unit under the guiding influence of the guide cam and guide rollers.

3 Claims, 3 Drawing Sheets

SUCTION TRANSFER ACTUATION SYSTEM FOR A MULTI-COLOR SHEET-FED ROTARY PRINTING PRESS

FIELD OF THE INVENTION

The present invention relates generally to multi-color sheet-fed rotary printing presses and more particularly concerns a suction transfer actuation system for a sheet transfer drum of such presses for turning successive sheets by rear-edge turning during the sheet transfer from one printing unit to another to facilitate printing on the back side of the sheets.

BACKGROUND OF THE INVENTION

A suction system for peeling off a sheet from the impression cylinder and transferring the sheet to the first gripper system of a transfer drum is known generally from DE-AS 2,451,987 wherein the suction arms are guided by a transmission system along a trochoidal path with the suction arm ends engaging the rear end of the sheet before the point of tangency between the impression cylinder and the transfer drum and effecting a transfer of the sheet to the first gripper system not later than the point of tangency between the cylinder and drum. However, the time available for engaging and moving the sheet into the transfer position, particularly at high printing press speeds, is so short that guiding the suction arms along the trochoidal path leads to very high acceleration forces and undesirable pivoting angles of the suction arms.

OBJECTS AND SUMMARY OF THE INVENTION

It is the primary aim of the present invention to provide a suction transfer actuation system which enables the rear edge of a sheet on the impression cylinder to be taken over accurately by the suction transfer arms and to be transferred accurately to the first gripper system of the two gripper systems on the transfer drum which oscillate toward and away from one another.

In carrying out the invention, a plurality of suction arms are rigidly connected to a hollow suction rocker shaft connected to actuating levers carrying guide rollers engaging curved guide cam surfaces on a guide bar mounted on the transfer drum. The suction actuation system is driven by way of a cam rigidly mounted on the press frame engaged by a cam follower roller to oscillate a drive lever coupled by a link to a drive arm on the rocker shaft to rock the suction arms toward and away from the impression cylinder under the guiding influence of the guide cam and guide rollers. In the preferred embodiment, a pair of outer cam rollers engage a curved outer guide cam surface and an inner cam roller coaxial with the axis of the hollow rocker shaft engages a curved inner guide cam surface.

The arrangement of the suction actuation system of the present invention enables the suction surfaces on the suction arms to tangentially engage the rear edge of a sheet on the impression cylinder well in advance of the tangency point between the impression cylinder and the transfer drum. After the sheet has been engaged by the suction surfaces of the suction arms, the guide cam and rollers cause the suction arms to draw the sheet over a prolonged distance and below the outer periphery of the transfer drum still in advance of the tangency point between the cylinder and drum and thereby avoid creating a detrimental or excessive angle between the suction surfaces of the suction arms and the sheet as the sheet is transferred to the first gripper system of the transfer drum. The first gripper system on the transfer drum then performs its pivoting rear-edge sheet turning movement independently of the rocking movement of the suction transfer actuation arms.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
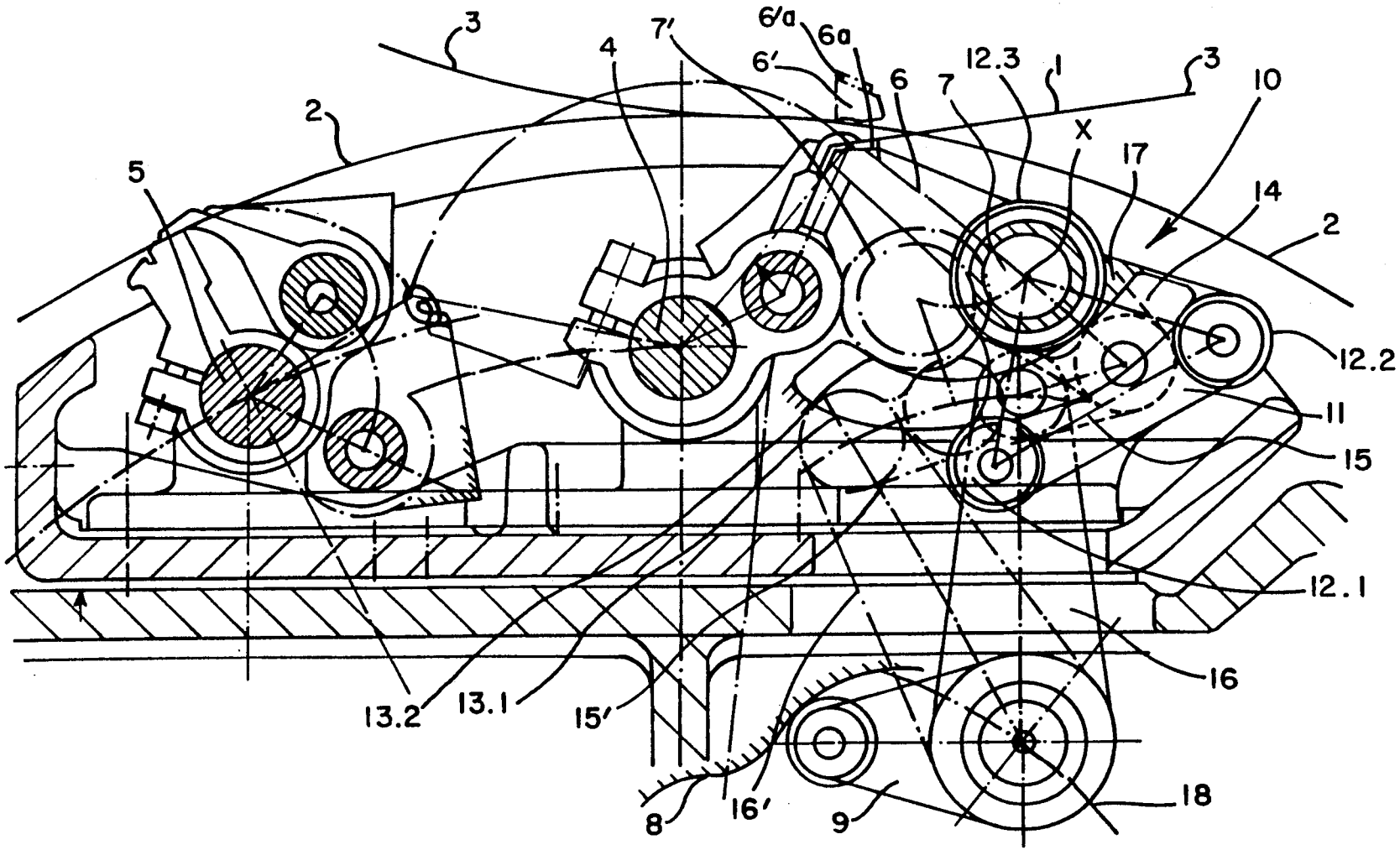
FIG. 1 is a partial sectional view through a sheet transfer drum of a rotary printing press including the suction transfer actuation system of the present invention with the suction transfer arms shown in the phase wherein the rear end of a sheet is transferred to the first gripping system.

Turning now to the drawings, FIG. 1 shows a portion of a multi-color sheet-fed rotary printing press including a sheet transfer drum 2 and an impression cylinder 3 from which a sheet 1 is being peeled by the suction transfer system 10 of the present invention. As shown here in solid lines, the suction surface *6a* of one of a plurality of suction transfer arms 6 is engaging the rear end of the sheet 1 in the phase in which it is being transferred to the first gripper system 4 disposed on the transfer drum 2. It will be understood that the first gripper system 4 pivots or rocks toward (and away from) a second rocking gripper system 5 and transfers the rear end of the sheet to it, as is shown in phantom lines. Pivotal or rocking movement of the second gripper system 5 away from the first gripper system turns the sheet over by rear-edge turning and presents it to the grippers on a second impression cylinder (not shown) so that the back side of the sheet may be printed, as is conventional in presses of this kind.

Figure 2:
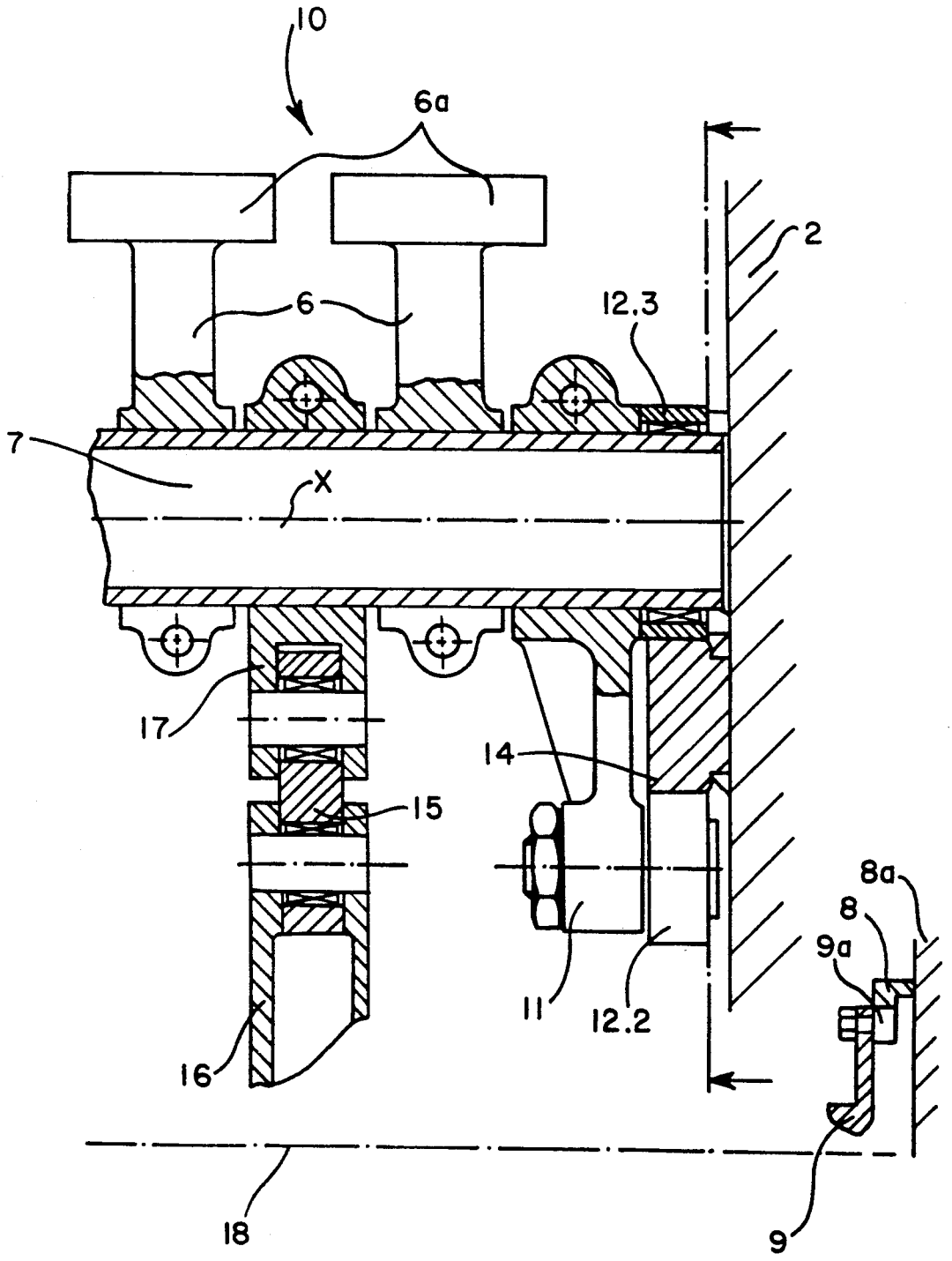
FIG. 2 is an enlarged, fragmentary plan view, partly in diagrammatic form, of the suction transfer actuation system shown in FIG. 1.

As is more clearly shown in FIG. 2, the suction transfer arms 6 of the suction transfer system 10 are rigidly connected to a hollow suction rocker shaft 7 which is also rigidly connected to actuating levers 11, only one of which is shown. Each of the actuating levers 11 carries guide cam roller means 12 which, in the preferred embodiment includes a pair of outer guide cam rollers 12.1 and 12.2 and an inner guide cam roller 12.3 disposed coaxially with the axis X of the hollow suction rocker shaft 7.

To control the movement of the axis X of the rocker shaft 7, guide bars 14 (only one of which is shown) are rigidly mounted on each end face of the transfer drum 2, as shown in FIG. 2. The guide bars 14 are arcuate shaped and are provided with a curved outer cam surface 13.1 and a curved inner cam surface 13.2 against which the outer guide rollers 12.1 and 12.2 and the inner guide roller 12.3, respectively, are engaged and roll back and forth from the right hand solid-line position illustrated in FIG. 1, to a left-hand position and then return. (See, e.g., movement of arm 6 to 6', shaft 7 to 7' and lever 16 to 16'.)

Figure 3:
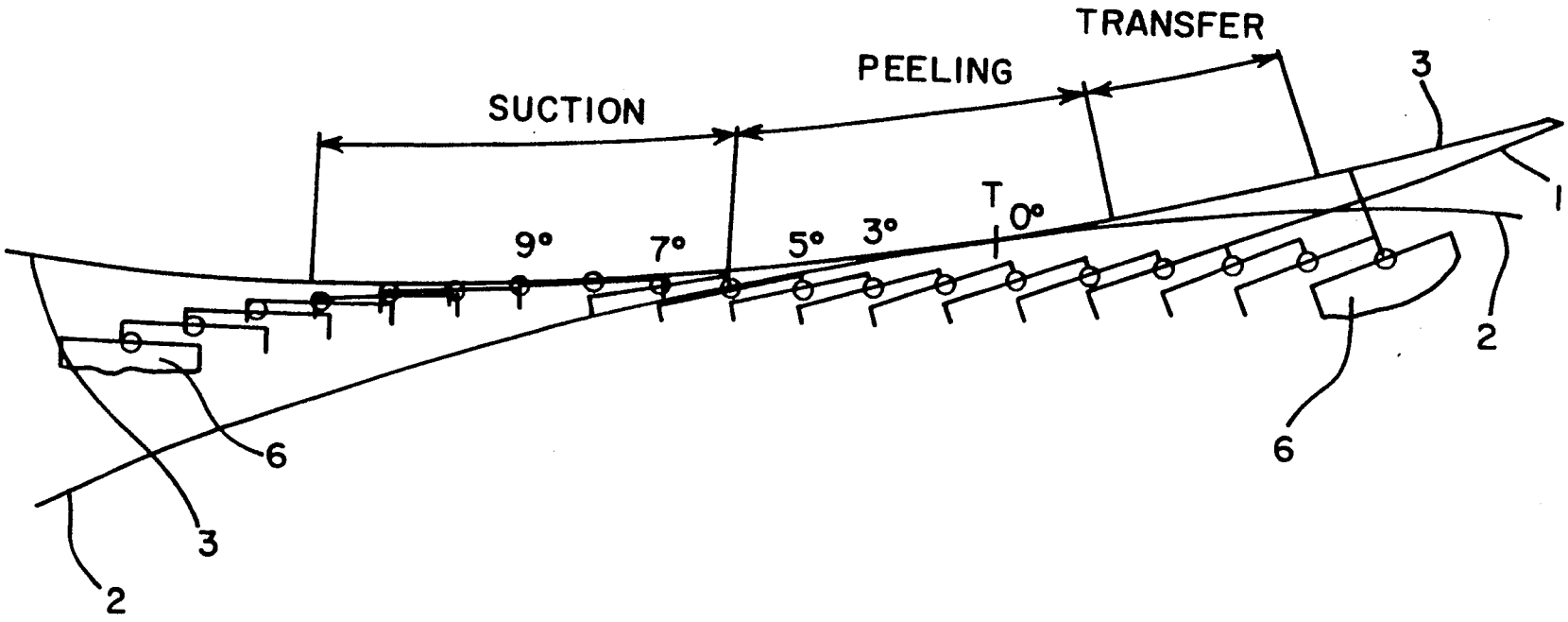
FIG. 3 is a schematic side view of the path of the suction surface of one of the suction transfer arms as it engages the rear end of a sheet on the impression cylinder and peels the sheet away from the impression cylinder.

As the hollow suction shaft 7 is rocked by the drive mechanism to be hereinafter described, the guide cam rollers 12 and guide cam surfaces 13 produce a movement pattern enabling the suction surfaces 6*a* of the suction arms 6 secured to the suction shaft 7 to move along a path as shown schematically in detail in FIG. 3. In a first phase, labeled "Suction" in FIG. 3, the suction surfaces 6*a* engage the rear edge of the sheet 1 on the periphery of the impression cylinder 3 (this corresponds to position 6'*a* in FIG. 1) and move over an elongated path adjacent the periphery at the same speed as the impression cylinder. In a second phase, labeled "Peeling," the suction surfaces 6*a* are moved below the periphery of the transfer drum 2 before the tangency point T of the drum 2 and cylinder 3. Since the sheet 1 is retained rigidly by the suction surfaces 6*a*, the sheet 1 is peeled off the impression cylinder 3 as the suction surfaces 6*a* follow along a modified involute path in a moving coordinate system of the rotating transfer drum 2 and the impression cylinder 3. In the third and final phase, labeled "Transfer," the suction surfaces 6*a* transfer the rear edge of the sheet 1 to the first gripper system 4 without any appreciable alteration in the deflection angle between the suction surfaces 6*a* and the sheet 1.

The foregoing path control provided by the suction transfer actuation system 10 of the present invention ensures that the sheet 1 is engaged reliably and allows space for the introduction of the finger of the first gripper system 4. It will be understood that the gripper finger moves, in a known manner, not described further herein, toward the sheet 1 resting on the suction surfaces 6*a*. Because the cam guide bars 14 are rigidly secured (either internally or externally) to the ends of the transfer drum 2 there is essentially no possibility of relative displacement occurring between the drum 2 and the cam surfaces 13, even after a prolonged period of operation.

To drive the suction transfer actuation system 10 of the present invention, a drive cam 8 is rigidly secured to the press frame 8*a*. A drive lever 16 is secured to a drive shaft 18 rotatably mounted in the transfer drum 2 and is pivotally connected by a connecting link 15 to a drive arm 17 secured to the hollow suction rocker shaft 7. A cam follower lever 9 is rigidly connected at one end to the drive shaft 18 and carries a cam follower roller 9*a* which engages and rolls on the camming surface of the drive cam 8 to produce an oscillating movement to the drive shaft 18 and drive lever 16. This oscillating movement of the drive lever 16 is communicated by the connecting link 15 and drive arm 17 to the suction rocker shaft 7 which is rocked back and forth between the right-hand solid-like and left-hand dash-line positions illustrated in FIG. 1 under the influence of the guide cam rollers 12 rolling on the guide cam surfaces 13. In FIG. 2, only a portion of the drive cam follower lever 9 is shown carrying the cam follower roller 9*a* engaging the camming surface of the drive cam 8 rigidly secured to the press frame 8*a*.

In the illustrated and preferred embodiment, two guide rollers 12.1 and 12.2 engage the outer guiding cam surface 13.1 of the arcuate guide bar 14 and an inner guide roller 12.3 engages the inner guide cam surface 13.2, although the arrangement of the guide rollers could be reversed, if desired. The three-point disposition of the guide rollers 12 provides excellent centering and stability for the suction transfer actuation system 10 of the present invention, as will be clear upon reference to FIGS. 1 and 2.

To further compensate for unavoidable minor guide cam surface errors and irregularities, the guide rollers 12.1 and 12.2 can be spring biased against the outer cam guide surface 13.1, if desired. This is not shown in the present drawings but, it is known, for example from FIGS. 2 and 3 of DE-PS 3,333,050 for cam follower rollers to be spring biased. It will also be understood that an auxiliary cam roller could also be spring biased into engagement with the inner cam guide surface 13.2.

Referring again to FIG. 1, it will be seen that the suction arm 6, as seen in the solid line illustration, has been rocked into position for the rear edge of the sheet 1 to be engaged and gripped by the gripper fingers of the first gripper system 4. Preferably, the suction arm 6 is pivoted or rocked until it engages an abutting stop (not shown) in order to accurately and positively define the position of the sheet rear edge for pickup by the first gripper system each time a new sheet is presented, even at very high printing press speeds.

It will also be understood that, and as it has been briefly mentioned previously herein, the first gripper system 4 transfers the rear edge of the sheet 1 to a second gripper system 5 and the second gripper system 5 then transfers the sheet to the gripper system of the impression cylinder of a second printing unit (not shown) for printing on the back side of the sheet. This type of rear-edge sheet turning is well-known in the art and its principle is described in detail and illustrated in DE-PS 1,786,371, for example.

We claim as our invention:

1. A suction transfer actuation system for a multicolor sheet-fed rotary printing press having a press frame, first and second printing units and a sheet transfer drum including first and second gripper means disposed thereon for rocking movement toward and away from one another for receiving successive sheets from the first printing unit and, after rear-edge turning, delivering the sheets to the second printing unit, said suction transfer actuation system comprising, in combination, a plurality of hollow suction arms disposed on said transfer drum ahead of said first gripper means, said suction arms having proximate and distal ends and being of a substantially non-extensible rigid structure with relatively non-movable internal portions, means including a hollow suction rocker shaft disposed on said transfer drum for rigidly supporting the proximate ends of said hollow suction arms and for rocking the distal ends of said suction arms toward and away from the first printing unit and for causing engagement between the distal ends of said suction arms and a sheet of printing material carried by said first printing unit, said engagement being effected through the rocking motion of said hollow suction rocker shaft and without relative movement of said internal portions of said hollow suction arms, said rocking means further comprising:

at least one actuating lever rigidly connected at one end to said hollow rocker shaft, a guide rail defining a curved guide cam surface mounted on the transfer drum, guide roller means mounted on the other end of said actuating lever for rolling engagement with said guide cam surface, a drive cam rigidly mounted on the press frame, and drive means dispose don the transfer drum for rocking said hollow suction shaft and said hollow suction arms under the influence of said guide cam and guide roller means, said drive means including a drive shaft mounted for rotation on the transfer drum, a drive lever rigidly connected at one end to said drive shaft, a drive arm rigidly connected at one end to said hollow rocker shaft, a drive link pivotally connected at its opposite ends, respectively, to the other ends of said drive lever and said drive arm, a cam follower lever rigidly connected at one end to said drive shaft, and a cam follower roller rotatably mounted on the other end of said cam follower lever and engageable with said drive cam for oscillating said drive shaft and drive lever so as to rock said distal ends of said hollow suction arms toward and away from the first printing unit under the guiding influence of said guide cam and guide roller means.

2. A suction transfer actuation system as defined in claim 1 wherein said guide rail includes inner and outer curved guide cam surfaces, said guide roller means includes a pair of outer guide rollers engaging said outer cam surface and an inner guide roller engaging said inner cam surface, said inner guide roller being disposed coaxially on the axis of said hollow suction rocker shaft.

3. A suction transfer actuation system as defined in claim 2 including a pair of said guide rials mounted on the transfer drum, one guide rail being mounted adjacent each end of the transfer drum.

* * * * *